US006572352B2

(12) United States Patent
Reinhart

(10) Patent No.: US 6,572,352 B2
(45) Date of Patent: Jun. 3, 2003

(54) TWO-PIECE POWDERED METAL SUCTION FITTING

(75) Inventor: Keith J. Reinhart, Sidney, OH (US)

(73) Assignee: Copeland Corporation, Sidney, OH (US)

( * ) Notice: Subject to any disclaimer, the term of this patent is extended or adjusted under 35 U.S.C. 154(b) by 0 days.

(21) Appl. No.: 09/982,283

(22) Filed: Oct. 16, 2001

(65) Prior Publication Data

US 2003/0072662 A1 Apr. 17, 2003

(51) Int. Cl.[7] ..... F01C 1/02

(52) U.S. Cl. ..... 418/55.1; 418/47; 418/179; 418/270; 417/53

(58) Field of Search ..... 418/55.1, 179, 418/47, 270; 417/53

(56) References Cited

U.S. PATENT DOCUMENTS 3,208,667 A * 9/1965 Boettcher ..... 418/94
5,110,268 A * 5/1992 Sakurai et al. ..... 418/55.6
5,141,422 A 8/1992 Ito et al.
5,232,355 A * 8/1993 Fujii et al. ..... 418/55.6
5,316,454 A 5/1994 Fujitani et al.
5,474,433 A * 12/1995 Chang et al. ..... 418/55.4
5,683,236 A * 11/1997 Harrison et al. ..... 418/55.1
6,015,277 A * 1/2000 Richardson, Jr. ..... 418/55.5
6,017,205 A * 1/2000 Weatherston et al. ..... 418/89
6,082,972 A * 7/2000 Moore et al. ..... 417/53
6,210,132 B1 4/2001 Shiinoki et al.
6,315,536 B1 * 11/2001 DeVore et al. ..... 418/55.6

FOREIGN PATENT DOCUMENTS

JP 07-155936 * 6/1995 ..... 418/55.6

* cited by examiner

*Primary Examiner*—Thomas Denion
*Assistant Examiner*—Theresa Trieu
(74) *Attorney, Agent, or Firm*—Harness, Dickey & Pierce, P.L.C.

(57) ABSTRACT

A suction fitting for a scroll machine is disclosed. The suction fitting is formed by a powder metal suction plate and a cast suction tube. The suction fitting is configured so that the powder metal suction plate is not subject to pressure gradients caused by the compressor.

17 Claims, 4 Drawing Sheets

TWO-PIECE POWDERED METAL SUCTION FITTING

FIELD OF THE INVENTION

The present invention relates to scroll machines. More particularly, the present invention relates to scroll compressors, which incorporate a unique two-piece suction inlet fitting.

BACKGROUND AND SUMMARY OF THE INVENTION

Scroll type machines are becoming more and more popular for use as compressors in both refrigeration as well as air conditioning applications due primarily to their capability for extremely efficient operation. Generally, these machines incorporate scroll members having a pair of intermeshed spiral wraps, one of which is caused to orbit relative to the other so as to define one or more moving chambers which progressively decrease in size as they travel from a radially outer suction port toward a radially inner or center discharge port. Some type of power unit is provided which operates to drive the orbiting scroll member via a suitable drive shaft. The bottom or lower portion of the housing which contains the scroll members normally contains an oil sump for lubrication of the various moving components of the compressor.

Scroll machines can be separated into two categories based upon the positioning of the power unit which drives the scroll member. The first category is scroll machines which have the power unit located within the housing or shell along with the scroll members. The housing or shell containing the power unit and the scroll members can be open to the environment or it can be sealed to provide a hermetic scroll machine wherein the housing or shell also contains the working fluid to be compressed by the scroll machine. The second category of scroll machines is scroll machines which have the power unit separate from the housing containing the scroll members. These machines are known as open drive scroll machines and the housing which contains the scroll members is normally sealed from the environment such that the housing contains the scroll members and the working fluid being compressed by the scroll members. The power unit for these open drive scroll machines can be provided by a drive belt and a pulley system, a gear drive system, a direct drive system, or any other type of drive system.

Each of the above two categories of scroll machines can be further subdivided into two additional categories. These two categories would be scroll members which rotate on a vertical axis, and scroll members which rotate on a horizontal axis. Open drive type of scroll machines which have the power unit exterior to the hermetic shell are the most popular type of compressors with the rotational axis of the scroll members positioned horizontally. Both the compressors having the rotational axis of the scroll members positioned vertically and horizontally have similar issues and/or problems which must be addressed. One of these common problems is to control the amount of lubricant which is ingested by the suction port defined by the scroll members.

During the operation of the scroll machine, the lubricant is distributed to the various moving components of the compressor. In a compressor where most of the moving components are located within the suction chamber of the compressor, the lubricant in mist form is usually present throughout the suction chamber. The scroll members ingest the working fluid into their suction port along with a certain amount of the lubricant in mist form. The working fluid and lubricant are compressed by the scroll members and delivered through a discharge outlet to the components which make up the system using the compressed working fluid. Once the system has utilized the compressed working fluid, it is returned to the hermetic housing or shell through a suction inlet.

The present invention provides the art with a unique suction fitting. The fitting is located at the suction inlet of the compressor and is designed to direct the returning working fluid into the compressor's working chamber. The fitting is formed by an outer powder metal suction plate which is disposed about a metal suction tube. The suction fitting is configured so the suction tube retains a fine meshed screen. Furthermore, the powder metal suction plate, which is used to couple the working chamber to a compressor's working fluid return system, is not subject to any pressure gradients formed by a functioning compressor. The suction fitting is formed by brazing a powder metal suction plate in its green or unsintered state to a cast suction tube.

Other advantages and objects of the present invention will become apparent to those skilled in the art from the subsequent detailed description, appended claims, and drawings.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
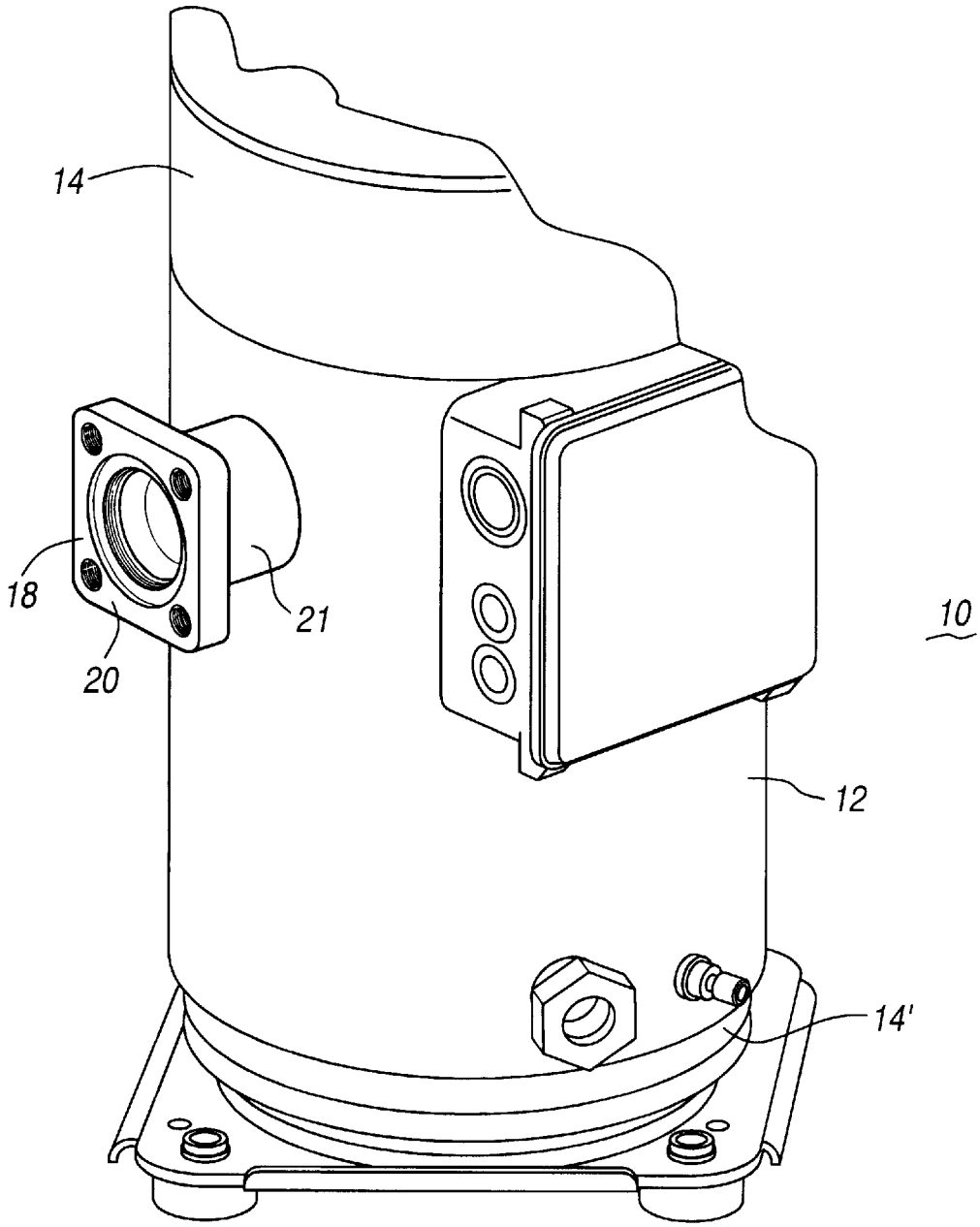
FIG. 1 in a sectional view of a compressor utilizing the two-piece suction coupling of the present invention.
Figure 2:
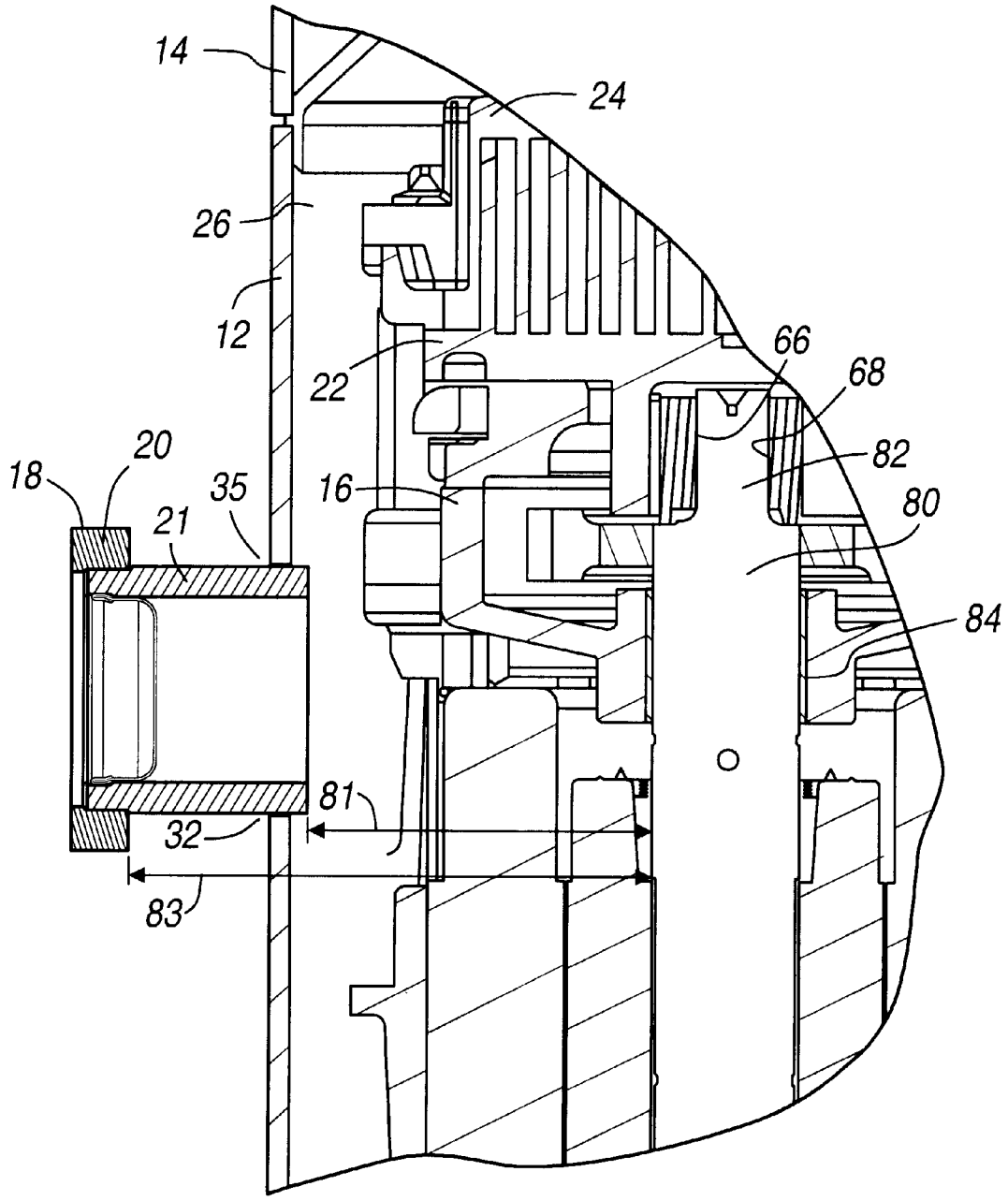
FIG. 2 is a vertical cross-section of a hermetically sealed vertical drive scroll machine of FIG. 1 incorporating the unique suction fitting in accordance with the present invention.

Referring now to the drawings in which like reference numerals designate like or corresponding parts throughout the several views, there is shown in FIGS. 1–2 a hermetically sealed scroll compressor which incorporates the unique two piece suction fitting in accordance with the present invention and which is designated generally by the reference numeral 10. Compressor 10 comprises a compressor body 12, a cap assembly 14, a main bearing housing 16, a drive and an oil pump assembly (not shown), an orbiting scroll member 22, and a non-orbiting scroll member 24. The orbiting scroll member 22 and a non-orbiting scroll member 24 define a scroll suction inlet positioned adjacent to the main bearing housing 16 and is located radially inward from said scroll suction inlet 35. While the unique suction fixing 18 of the present invention is being disclosed on a hermetically sealed vertically driven compressor, it is within the scope of the present invention to utilize the suction fitting of the present invention in a horizontal open drive compressor as well as both a horizontal and vertical compressor having the power unit within the housing or shell. The suction fitting 18 is formed by a powder metal suction plate 20 and suction tube 21. The suction tube 21 extends into the chamber 26 a distance 81 from the drive shaft 80, while the suction plate is located a second greater distance 83 from the drive shaft 80.

Compressor body 12 is generally cylindrical shaped and is preferably constructed from steel. The body 12 defines an internal cavity 26 within which is located main bearing housing 16, and a suction inlet 35 for mating with the refrigeration circuit (not shown) associated with compressor 10. Compressor 10, body 12, and upper and lower cap assembly 14 and 14' define a sealed chamber 34 within which scroll member 22 and 24 are disposed.

A steel drive shaft or crankshaft 80 having an eccentric crank pin 82 at one end thereof is rotatably journaled in a sleeve bearing 84 in main bearing housing 16 and a bearing in lower bearing assembly (not shown). Crank pin 82 is drivingly disposed within inner bore 68 of drive bushing 66. Crank pin 82 has a flat on one surface which drivingly engages a flat surface (not shown) formed in a portion of bore 68 to provide a radially compliant drive arrangement, such as shown in assignee's U.S. Pat. No. 4,877,382.

Oil pump assembly (not shown) is disposed within chamber 34 in concentric relationship to drive shaft 80. Oil pump assembly, which is located centrally with respect to drive shaft 80, pumps oil to all functional areas of compressor 10 as well as through a filtering system to continuously remove contaminates and debris from the cooling oil. Oil pump assembly removes oil from a sump (not shown) and distributes it throughout compressor 10.

Figure 3:
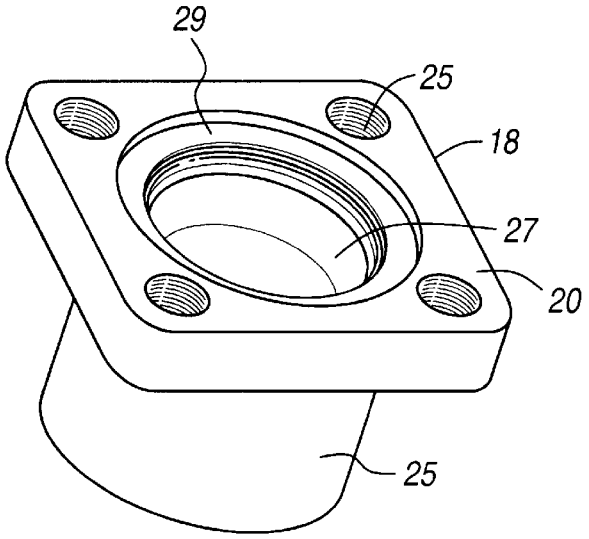
FIG. 3 is a perspective view of the two-piece suction fitting of the present invention.

FIG. 3 is a perspective view of the two-piece suction fitting 18 of the present invention. Radially positioned about suction tube 21 is powder metal suction plate 20. Suction tube 21 and powder metal suction plate 20 are coupled using brazing techniques. Preferably, the brazing techniques are applied while the powder metal suction plate 20 is still in its green state. The powder metal suction plate 20 has four mounting holes 25, which can be threaded, and a single through hole 27 for accepting the suction tube 21.

Figure 4:
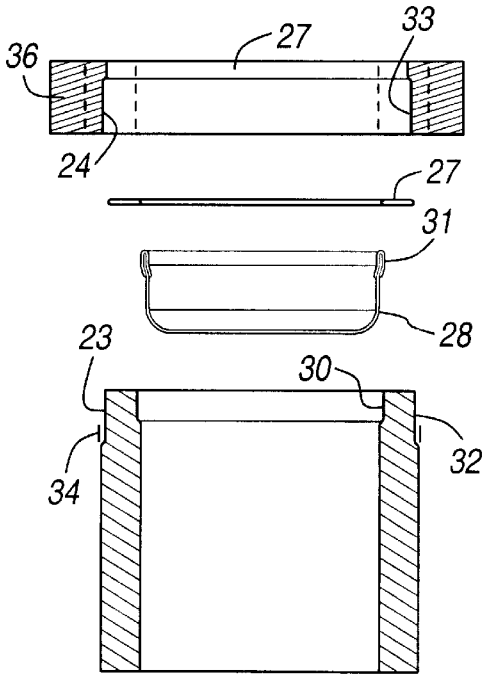
FIGS. 4–4*b* are views of the suction fitting according to the present invention.
Figure 4A:
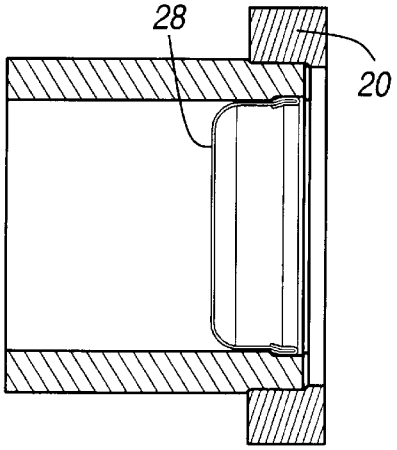
Figure 4B:
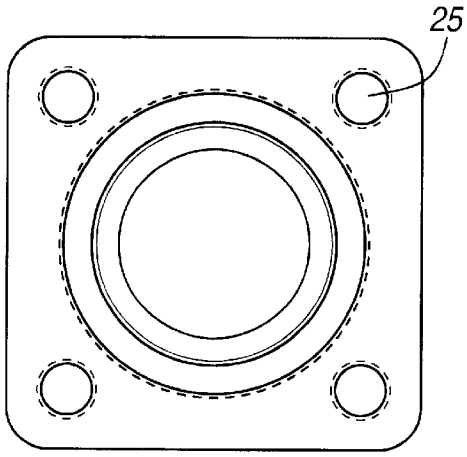

As can be seen in FIGS. 4–4*b*, the through hole 27 has a first section 33 which accepts a mating portion 32 of the suction tube 21. Optionally, brazement materials 34 can be disposed between, or adjacent to, the first section 33 of the powder metal suction plate 20 and the mating portion 32 of the suction tube 21. Disposed within the powder metal suction plate 20 and suction tube 21 assembly is a filtering screen 28. The filtering screen 28 has a flange 31, which is used to couple to interior ledge 30 within the suction tube 21. Additionally, the gasket 29 is provided which facilitates mounting all of the suction fitting 18 to the coolant system.

The use of brazing materials 34 has the advantage that a hardened zone forms at the joint interface such as with welding described above. The suction plate 20 or suction tube 21 preferably defines at least one notch 23 capable of accepting flowing liquid brazing metal. It is preferable to use a braze material 34 with a fluxing agent that cleans off the components sufficiently enough to allow wetting (such as the black type fluxes AWS FB3-C or AMS 3411).

A challenge to brazing is that braze material 34 tends to excessively wick into the porous powder metal part. If excessive, this can cause a poor braze joint because the braze material 34 becomes removed from the joining surfaces. A solution to this is to use a braze material 34 that minimizes wicking effect. The required braze alloy must react with the powder metal surface. This reaction minimizes the amount of wicking that occurs by producing a metallurgical compound that melts at a higher temperature than the current brazing temperature. One such braze alloy is SKC-72 which has the composition by weight of 30–50% copper, 10–20% manganese, 3–25% iron, 0.54% silicon, 0.5–2% boron, and balance (30–50%) nickel. Good green strength and acceptable levels of base metal dissolution are satisfied by the addition of certain elements especially iron.

The braze material 34 may be wrought form, a paste or a powder metal, or cast preform placed into a groove 24 on the powder metal suction plate 20 prior to brazing. Care when using pastes must be exercised to ensure that gas does not develop during brazing. The brazing method is preferably furnace brazing. Furnace brazing has the advantage of being able to braze in a protective atmosphere which will aid in wetting. The brazing of the components is performed simultaneous to sintering the suction plate.

As is best seen in FIGS. 4–4*b*, the suction fitting 18 according to the present invention is configured so the powder metal suction plate 20 is not subjected to pressure differentials within the suction fitting 18. These pressure differentials are bore by the cast suction tube 21.

Figure 5:
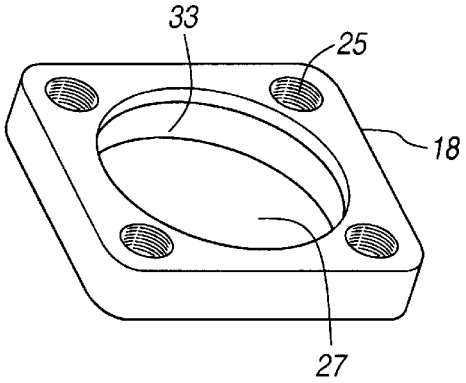
FIGS. 5–5*b* are views of the suction plate according to the present invention.
Figure 5A:
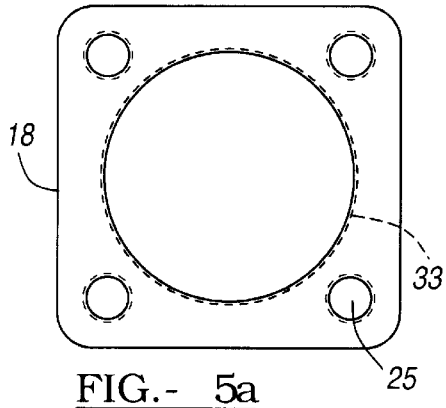
Figure 5B:
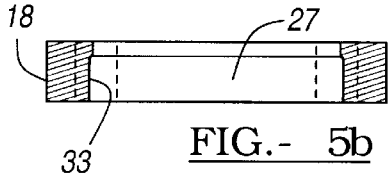

FIGS. 5–5*b* are views of the powder metal suction plate 20 according to the present invention. The powder metal suction plate 20 is formed using sintered powder metal techniques. These techniques utilize binders 36 to hold metal powders together in a green state prior to sintering of the powders. There are several binder 36 systems envisioned for use in the powder metal suction plate 20 formation process: wax-polymer, acetyl based, water soluble, agar water based and water soluble/cross-linked. "acetyl" based binder 36 systems have as main components polyoxymethylene or polyacetyl with small amounts of polyolefin. The acetyl binder 36 systems are crystalline in nature. Because of the crystalinity, the molding viscosity is quite high and requires close controls on the molding temperature. This binder 36 is debound by a catalytic chemical de-polymerization of the polyacetyl component by nitric acid at low temperatures. This binder 36 and debinding process is faster particularly for thicker parts. Molding temperatures are about 180° C. and mold temperatures are about 100–140° C., which is relatively high.

It is further envisioned that a "wax-polymer" binding system may be used. This binding system has good moldability, but since the wax softens during debinding, distortion is a concern. Fixturing or optimized debinding cycles are needed and may overcome this. It is envisioned that a multi-component binder 36 composition may be used so that properties change with temperature gradually. This allows a wider processing window. Wax-polymer systems can be debound in atmosphere or vacuum furnaces and by solvent methods. Typical material molding temperatures are 175° C., and mold temperatures are typically 40° C.

It is further envisioned that a "water soluble" binder 36 may be used. "Water soluble" binders 36 are composed of polyethylene with some polypropylene, partially hydrolyzed cold water soluble polyvinyl alcohol, water, and plasticizers. Part of the binder 36 can be removed by water at about 80–100° C. Molding temperatures are about 185° C. This system is environmentally safe, non-hazardous, and biodegradable. Because of the low debinding temperatures, the propensity for distortion during debinding is somewhat low.

It is further envisioned that "agar-water" based binders be used. Agar-water based binders 36 have an advantage because evaporation of water causes debinding, and no separate debinding processing step is needed. Debinding can be incorporated into the sinter phase of the process. Molding temperature is about 85° C., and the mold temperature is cooler. One caution is that during molding water loss may occur that affects both metal loading and viscosity. Therefore, careful controls need to be incorporated to avoid evaporation during processing. Another disadvantage is that the as molded parts are soft and require special handling precautions. Special drying immediately after molding may be incorporated to assist in handling.

It is further envisioned that a "water soluble/cross-linked" binder 36 be used. Water soluble/cross-linked binders involve initial soaking in water to partially debind, and then a cross-linking step is applied. This is sometimes referred to as a reaction compounded feedstock. The main components are methoxypolyethylene glycol and polyoxymethylene. This binder/debinding system results in low distortion and low dimensional tolerances. Also, high metal loading can be achieved when different powder types are blended.

Optionally, fixturing during debinding and/or sintering may help to prevent part slumping. It has been found that "under-sintering" (but still densifying to the point where density/strength criteria are met) helps to maintain dimensional control. Fixturing may be accomplished by using graphite or ceramic scroll form shapes to minimize distortion.

The final sintered density of the suction plate 20 shall be about 6.5 gm/cm$^3$ minimum (preferably 6.7 gm/cm$^3$ minimum). The density shall be as uniformly distributed as possible. The density minimum must be maintained to comply with the fatigue strength requirements of the scroll. Leakage through the interconnected metal porosity is not a concern because of the configuration with the steel suction tube 21. The incorporation of higher density with no other treatments may be sufficient to produce pressure tightness. Also, impregnation, steam treatment or infiltration (polymeric, metal oxides, or metallic) may be incorporated into the pores to seal off interconnected pores, if necessary.

The material composition of the final part shall be about 0.20–0.6% carbon, 0–4% copper, and remainder iron. Preferably, the material composition of the final part shall be about 0.4% carbon, 2% copper, and remainder iron. Other minor constituents may be added to modify or improve some aspect of the microstructure, such as grain size or pearlite fineness. The final material microstructure shall be similar to cast iron. Furthermore, the material shall have at least one percent elongation and a minimum hardness $R_b$ equal to 65.

Figure 6:
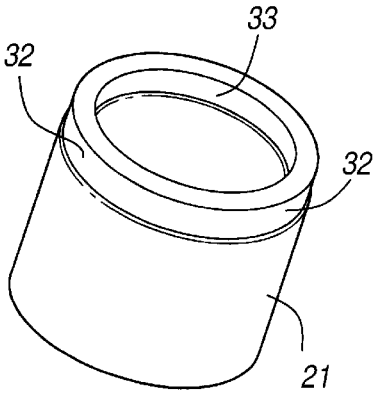
FIGS. 6–6*b* are views of the suction tube according to the present invention.
Figure 6A:
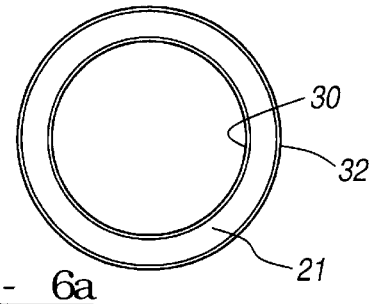
Figure 6B:
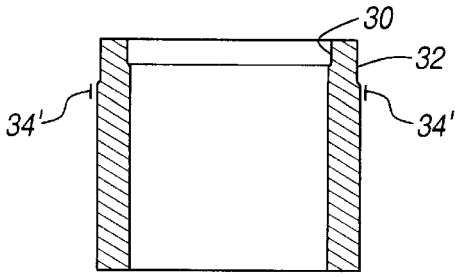

FIGS. 6–6*b* are views of the suction tube 21 according to the present invention. It is envisioned that suction tube 21 is formed utilizing standard steel forming techniques. The suction tube 21 is a cylinder which is brazed or welded to the compressor body 12. As can be best seen in FIG. 6*b*, the suction tube 21 defines the interior ledge and coupling portions 30 and 32.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A scroll machine comprising:

a compressor housing defining a chamber and a housing suction inlet to said chamber;

a first scroll member disposed within said chamber, said first scroll member having a first spiral wrap;

a second scroll member disposed within said chamber, said second scroll member having a second spiral wrap intermeshed with said first spiral wrap;

a drive shaft rotatably supported with respect to said compressor housing, said drive shaft receiving rotational input and transferring said rotational input to one of said scroll members for causing said scroll members to orbit relative to one another; and a suction fitting coupled to the housing suction inlet comprising a powder metal suction plate and a suction tube.

2. The scroll machine according to claim 1, wherein said powder metal suction plate is disposed around said a suction tube.

3. The scroll machine according to claim 2, wherein said first and second scroll members define a scroll suction inlet, in a position adjacent said bearing housing being located radially inward from said scroll suction inlet.

4. The scroll machine according to claim 1, wherein said suction fitting further comprises a screen disposed within said suction tube.

5. The scroll machine according to claim 1, wherein said suction tube cast iron.

6. The scroll machine according to claim 1, wherein said first and second scroll members define a scroll suction inlet, said portion of said suction fitting into said chamber to a position radially inward from said scroll suction inlet.

7. A scroll machine comprising:

a compressor housing defining a chamber and a housing suction inlet open to said chamber;

a first scroll member disposed within said chamber, said first scroll member having a first spiral wrap;

a second scroll member disposed within said chamber, said second scroll member having a second spiral wrap intermeshed with said first spiral wrap, said first and second scroll members defining a scroll suction inlet;

a drive shaft rotatably supported about an axis by said compressor housing, said drive shaft receiving rotational input and transferring said rotational input to one of said scroll members for causing said scroll members to orbit relative to one another whereby said spiral wraps will create pockets of progressively changing volume between a suction pressure zone and a discharge pressure zone; and a suction fitting within said housing suction inlet, said suction fitting including a sintered powder metal suction plate and a suction tube which extends into said chamber to a first radial distance from said axis of said drive shaft, said scroll suction inlet being located at a second radial distance from said axis of said drive shaft, said second radial distance being greater than said first radial distance.

8. The scroll machine of claim 7 wherein said suction plate comprises sintered iron powder.

9. The scroll machine of claim 7 wherein said suction plate comprises: an iron powder having at least 90% pearlitic structure.

10. The scroll machine of claim 7 wherein the suction plate defines a groove capable of accepting said suction tube.

11. The scroll machine of claim 7 comprising a suction plate form formed of sintered iron powder.

12. The scroll machine of claim 7 wherein the suction plate further defines at least one notch capable of accepting flowing liquid metal.

13. The scroll machine of claim 7 further comprising a sacrificial brazement material.

14. The scroll machine of claim 7 wherein said notch comprises a brazing material disposed therein.

15. The scroll machine of claim 7 wherein the base member comprises a sacrificial brazing material disposed adjacent said tube.

16. The scroll machine according to claim 7, wherein said first and second scroll members are supported by a bearing housing disposed within said chamber, said portion extending into said chamber to said first radial distance being disposed adjacent said bearing housing.

17. The scroll machine according to claim 7, further comprising a screen disposed within said housing suction inlet.

* * * * *

UNITED STATES PATENT AND TRADEMARK OFFICE

CERTIFICATE OF CORRECTION

PATENT NO. : 6,572,352 B2
DATED : June 3, 2003
INVENTOR(S) : Keith J. Reinhart

It is certified that error appears in the above-identified patent and that said Letters Patent is hereby corrected as shown below:

Column 2,
Line 59, “fixing” should be -- fitting --.

Column 3,
Line 11, “member” should be -- members --.
Line 66, “0.54%” should be -- 0.5-4% --.

Column 4,
Line 23, “acetyl” should be -- “Acetyl” --.
Line 27, “crystalinity” should be -- crystallinity --.

Column 5,
Line 66, after “said” delete -- a --.

Column 6,
Line 9, after “tube” insert -- is --.

Signed and Sealed this

Twelfth Day of August, 2003

JAMES E. ROGAN
*Director of the United States Patent and Trademark Office*